US011774191B2

(12) United States Patent
Nilsson et al.

(10) Patent No.: US 11,774,191 B2
(45) Date of Patent: Oct. 3, 2023

(54) HEAT TRANSFER PLATE AND A PLATE PACK FOR A HEAT EXCHANGER COMPRISING A PLURALITY OF SUCH HEAT TRANSFER PLATES

(71) Applicant: ALFA LAVAL CORPORATE AB, Lund (SE)

(72) Inventors: Johan Nilsson, Ronneby (SE); Magnus Hedberg, Hjärup (SE)

(73) Assignee: ALFA LAVAL CORPORATE AB, Lund (SE)

( * ) Notice: Subject to any disclaimer, the term of this patent is extended or adjusted under 35 U.S.C. 154(b) by 431 days.

(21) Appl. No.: 16/753,098

(22) PCT Filed: Sep. 11, 2018

(86) PCT No.: PCT/EP2018/074380
§ 371 (c)(1),
(2) Date: Apr. 2, 2020

(87) PCT Pub. No.: WO2019/068426
PCT Pub. Date: Apr. 11, 2019

(65) Prior Publication Data

US 2020/0278158 A1 Sep. 3, 2020

(30) Foreign Application Priority Data

Oct. 5, 2017 (EP) ..... 17194863

(51) Int. Cl.
*F28F 3/08* (2006.01)
*F28D 9/00* (2006.01)

(52) U.S. Cl.
CPC ..... *F28F 3/08* (2013.01); *F28D 9/005* (2013.01)

(58) Field of Classification Search
CPC ..... F28D 9/005; F28D 9/0031; F28D 9/0043; F28F 3/046; F28F 3/083; F28F 3/08; F28F 3/10
See application file for complete search history.

(56) References Cited

U.S. PATENT DOCUMENTS 5,056,590 A 10/1991 Bohn
5,392,849 A 2/1995 Matsunaga et al.
(Continued)

FOREIGN PATENT DOCUMENTS

CN 1815123 A 8/2006
CN 203464823 U 3/2014
(Continued)

OTHER PUBLICATIONS

Office Action dated Dec. 15, 2020, by the National Intellectual Property Administration, P. R China in corresponding Chinese Patent Application No. 201880064956.4. (5 pages).
(Continued)

*Primary Examiner* — Jianying C Atkisson
*Assistant Examiner* — For K Ling
(74) *Attorney, Agent, or Firm* — BUCHANAN INGERSOLL & ROONEY PC

(57) ABSTRACT

A heat transfer plate comprises first, third and fourth guiding sections. The first and fourth guiding sections each comprise, as seen from a first side of the heat transfer plate, a male projection to engage the first adjacent heat transfer plate for aligning the plate and the first adjacent heat transfer plate, and, as seen from a second side of the heat transfer plate, a female recess to engage the second adjacent heat transfer plate for aligning the plate and the second adjacent heat transfer plate. The third guiding section comprises, as seen from the second side of the plate, a male projection to engage the second adjacent heat transfer plate for aligning
(Continued)

the plate and the second adjacent plate, and, as seen from the first side of the plate, a female recess to engage the first adjacent heat transfer plate for aligning the plate and the first adjacent plate.

20 Claims, 6 Drawing Sheets

(56) References Cited

U.S. PATENT DOCUMENTS

| | | | | |
|---|---|---|---|---|
| 5,967,227 | A | 10/1999 | Jensen et al. | |
| 2004/0226704 | A1* | 11/2004 | Sella | F28F 13/185 165/905 |
| 2007/0089872 | A1* | 4/2007 | Hou | F28F 9/026 165/167 |
| 2011/0240273 | A1 | 10/2011 | Blomgren et al. | |
| 2016/0040943 | A1* | 2/2016 | Han | F28D 9/005 165/157 |
| 2016/0313071 | A1* | 10/2016 | Andersson | F28F 3/08 |
| 2021/0293484 | A1* | 9/2021 | Sanchez | F28F 3/042 |

FOREIGN PATENT DOCUMENTS

| | | | | |
|---|---|---|---|---|
| CN | 103791756 | A | | 5/2014 |
| CN | 204188044 | U | | 3/2015 |
| CN | 205279836 | U | | 6/2016 |
| CN | 106197094 | A | | 12/2016 |
| EP | 1010928 | A1 | | 1/2001 |
| EP | 1 688 692 | A2 | | 8/2006 |
| EP | 2728293 | A1 | | 5/2014 |
| EP | 3 101 376 | B1 | | 6/2019 |
| EP | 1 963 771 | B1 | | 7/2019 |
| GB | 1298240 | A | | 11/1972 |
| JP | H08-233481 | A | | 9/1996 |
| JP | 11248392 | A | | 9/1998 |
| JP | H11-506533 | A | | 6/1999 |
| JP | 2000320986 | A | * | 11/2000 ..... F28D 9/005 |
| JP | 3675475 | B2 | | 5/2005 |
| JP | 2012-510606 | A | | 5/2012 |
| JP | 2014-055772 | A | | 3/2014 |
| RU | 64 333 | U1 | | 6/2007 |
| RU | 2 411 436 | C2 | | 2/2011 |
| RU | 2 623 346 | C1 | | 6/2017 |
| RU | 2 643 999 | C1 | | 2/2018 |
| WO | 9419657 | A1 | | 9/1994 |
| WO | 9639605 | A1 | | 12/1996 |
| WO | 9949271 | A2 | | 9/1999 |
| WO | 2010064975 | A2 | | 6/2010 |

OTHER PUBLICATIONS

Office Action (Notice of Reasons for Rejection) dated Jan. 25, 2021, by the Japanese Patent Office in corresponding Japanese Patent Application No. 2020-519384 and an English Translation of the Office Action. (7 pages).

International Search Report (PCT/ISA/210) dated Nov. 19, 2018, by the European Patent Office as the International Searching Authority for International Application No. PCT/EP2018/074380.

Written Opinion (PCT/ISA/237) dated Nov. 19, by the European Patent Office as the International Searching Authority for International Application No. PCT/EP2018/074380.

An English Translation of the Office Action (Decision to Grant) dated Sep. 29, 2020, by the Federal Service for Intellectual Property (Rospatent) in corresponding Russian Patent Application No. 2020114747/(024457). (10 pages).

Notice of Allowance dated Feb. 3, 2022 in corresponding Korean Patent Application No. 10-2020-7012335, with English language translation (4 pages).

* cited by examiner

HEAT TRANSFER PLATE AND A PLATE PACK FOR A HEAT EXCHANGER COMPRISING A PLURALITY OF SUCH HEAT TRANSFER PLATES

TECHNICAL FIELD

The invention relates to a heat transfer plate and its design. The invention also relates to a plate pack for a heat exchanger comprising a plurality of such heat transfer plates.

BACKGROUND ART

Plate heat exchangers, PHEs, typically consist of two end plates in between which a number of heat transfer plates are arranged in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

In one type of well-known PHEs, the so called gasketed PHEs, gaskets are arranged between the heat transfer plates. The end plates, and therefore the heat transfer plates, are pressed towards each other by some kind of tightening means, whereby the gaskets seal between the heat transfer plates. Parallel flow channels are formed between the heat transfer plates, one channel between each pair of adjacent heat transfer plates. Two fluids of initially different temperatures, which are fed to/from the PHE through inlets/outlets, can flow alternately through every second channel for transferring heat from one fluid to the other, which fluids enter/exit the channels through inlet/outlet port holes in the heat transfer plates communicating with the inlets/outlets of the PHE.

The end plates of a gasketed PHE are often referred to as frame plate and pressure plate. The frame plate is often fixed to a support surface such as the floor while the pressure plate is movable in relation to the frame plate. Often, an upper carrying bar for carrying the heat transfer plates, and possibly also the pressure plate, is fastened to the frame plate and extends from an upper part thereof, past the pressure plate and to a support column. Similarly, a lower guiding bar for guiding the heat transfer plates, and possibly also the pressure plate, is fastened to the frame plate and extends from a lower part thereof, on a distance from the ground, past the pressure plate and to the support column.

For a PHE to work properly, it is important that the heat transfer plates are aligned with each other in the stack since non-aligned heat transfer plates may result in a leaking PHE. Although the carrying and guiding bars of a heat exchanger may provide alignment of, by engagement with, the heat transfer plates, this alignment may be insufficient. Also, some PHEs may lack a carrying bar and/or a guiding bar. In view thereof, some heat transfer plates are provided with guiding sections wherein a guiding section of one heat transfer plate is arranged to engage with a guiding section of another heat transfer plate for alignment of the heat transfer plates. WO 2010/064975 discloses such heat transfer plates arranged in a stack wherein every other heat transfer plate is "rotated" in relation to the other heat transfer plates. Although WO 2010/064975 discloses a guiding solution that works very well, it is limited to alignment of heat transfer plates "rotated" in relation to each other.

SUMMARY

An object of the present invention is to provide a heat transfer plate which solves the above mentioned problem. The basic concept of the invention is to provide the heat transfer plate with a guiding solution which is more flexible than known solutions in that it enables alignment of the heat transfer plate and another heat transfer plate irrespective of whether the two heat transfer plates are "rotated" or "flipped" in relation to each other. Another object of the present invention is to provide a plate pack for a heat exchanger comprising a first, a second and a third such heat transfer plate. The heat transfer plate and the plate pack for achieving the objects above are defined in the appended claims and discussed below.

A heat transfer plate according to the present invention has opposing first and second sides, an outer edge and a central extension plane and includes an edge portion comprising corrugations. The corrugations extend between first and second planes which are parallel to the central extension plane, and the central extension plane is arranged between the first and second planes. The corrugations are arranged, at the first side of the heat transfer plate, to abut a first adjacent heat transfer plate, and at the second side of the heat transfer plate, to abut a second adjacent heat transfer plate, when the heat transfer plate is arranged in a plate heat exchanger. Longitudinal and transverse centre axes of the heat transfer plate extending parallel to the central extension plane and perpendicular to each other, define a first, a second, a third and a fourth plate area. The first and second plate areas are arranged on the same side of the transverse centre axis and the first and the third plate areas are arranged on the same side of the longitudinal centre axis. The first, third and fourth plate areas comprise a first, third and fourth guiding section, respectively. The heat transfer plate is characterized in that the first and fourth guiding sections each comprise, as seen from the first side of the heat transfer plate, a male projection projecting beyond the first plane and arranged to engage with the first adjacent heat transfer plate for alignment of the heat transfer plate and the first adjacent heat transfer plate, and, as seen from the second side of the heat transfer plate, a female recess arranged to engage with the second adjacent heat transfer plate for alignment of the heat transfer plate and the second adjacent heat transfer plate. Further, the third guiding section comprises, as seen from the second side of the heat transfer plate, a male projection projecting beyond the second plane and arranged to engage with the second adjacent heat transfer plate for alignment of the heat transfer plate and the second adjacent heat transfer plate, and, as seen from the first side of the heat transfer plate, a female recess arranged to engage with the first adjacent heat transfer plate for alignment of the heat transfer plate and the first adjacent heat transfer plate.

The first and second sides of the heat transfer plate may also be referred to as front and back side.

The central extension plane may be arranged half way between the first and second planes.

The longitudinal centre axis may extend along opposing long sides of the heat transfer plate, while the transverse centre axis may extend along opposing short sides of the heat transfer plate.

The edge portion may be an outer peripheral edge portion of the heat transfer plate or an inner edge portion such as an edge portion defining a port hole of the heat transfer plate. Further, the complete edge portion, or only one or more portions thereof, may comprise corrugations. The corrugations may be evenly or unevenly distributed along the edge portion, and they may, or may not, all look the same. The edge portion may comprise further corrugations extending within or outside the first and second planes.

The corrugations define ridges and valleys which may give the edge portion a wave-like design. As seen from the first side of the plate, when the heat transfer plate is arranged in a plate heat exchanger, the ridges are arranged to abut the first adjacent plate while the valleys are arranged to abut the second adjacent heat transfer plate.

The heat transfer plate may be essentially rectangular, and the longitudinal and transverse centre axes essentially perpendicular to each other so as to define four essentially rectangular plate areas.

"As seen from the first side of the heat transfer plate" means when the first side of the heat transfer plate is viewed at a distance. Similarly, "as seen from the second side of the heat transfer plate" means when the second side of the heat transfer plate is viewed at a distance.

The heat transfer plate and the first and second adjacent heat transfer plates may all be of the same type. Alternatively, the heat transfer plate and the first and second adjacent heat transfer plates may be of different types. For example, the heat transfer plate and the first and second adjacent heat transfer plates may all comprise guiding sections as defined in the claims but otherwise be differently designed.

The above configuration of the guiding sections may enable alignment of the heat transfer plate and an adjacent heat transfer plate irrespective of whether the adjacent heat transfer plate is rotated or flipped with respect to the heat transfer plate. Further, alignment of the heat transfer plate and the adjacent heat transfer plate by means of at least two of the guiding sections of the heat transfer plate may be enabled, which improves the alignment. Moreover, alignment of the heat transfer plate and two adjacent heat transfer plates, e.g. the first and second adjacent heat transfer plates referred to above, by means of each of said at least two of the guiding sections of the heat transfer plate may be enabled, which improves the alignment. The alignment enablement is naturally dependent on the design of the adjacent heat transfer plate(s).

The second plate area may comprise a second guiding section comprising, as seen from the second side of the heat transfer plate, a male projection projecting beyond the second plane and arranged to engage with the second adjacent heat transfer plate for alignment of the heat transfer plate and the second adjacent heat transfer plate, and, as seen from the first side of the heat transfer plate, a female recess arranged to engage with the first adjacent heat transfer plate for alignment of the heat transfer plate and the first adjacent heat transfer plate. Thereby, alignment of the heat transfer plate and the adjacent heat transfer plate by means of all of the guiding sections of the heat transfer plate may be enabled, which improves the alignment. Moreover, alignment of the heat transfer plate and two adjacent heat transfer plates, e.g. the first and second adjacent heat transfer plates referred to above, by means of each of all the guiding sections of the heat transfer plate may be enabled, which improves the alignment. Again, the alignment enablement is naturally dependent on the design of the adjacent heat transfer plate(s).

A respective top of the male projections of the first and second guiding sections may extend from a distance ML1 to a distance ML2 from the transverse centre axis and from a distance MW1 to a distance MW2 from the longitudinal centre axis, and a respective opening or root of the female recesses of the third and fourth guiding sections may extend from a distance FL1 to a distance FL2 from the transverse centre axis and from a distance FW1 to a distance FW2 from the longitudinal centre axis, wherein FL1<ML1<ML2<FL2 and FW1<MW1<MW2<FW2. Further, (each of) the male projections of the first and second guiding sections may fit into (each of) the female recesses of the third and fourth guiding sections. By "fit" is meant that the male projections at least partly could be received in the female recesses. For example, the male projections could have outer circumferences which are smaller than inner circumferences of the female recesses and/or outer surfaces of the male projections could define volumes which are smaller than volumes defined by inner surfaces of the female recesses. Naturally, reception of the male projections of a heat transfer plate in the female recesses of the same heat transfer plate is not relevant and impossible without deforming or cutting the heat transfer plate. However, this embodiment may enable alignment of the heat transfer plate and first and second adjacent heat transfer plates of the same type as the heat transfer plate, or at least comprising guiding sections as above defined, by insertion of the male projections of the first and second guiding sections of the heat transfer plate in the female recesses of the third and fourth guiding sections of the first and second adjacent heat transfer plates, and reception, of the male projections of the first and second guiding sections of the first and second adjacent heat transfer plates, by the female recesses of the third and fourth guiding sections of the heat transfer plate.

A respective top of the male projections of the third and fourth guiding sections may extend from a distance ML3 to a distance ML4 from the transverse centre axis and from a distance MW3 to a distance MW4 from the longitudinal centre axis, and a respective opening or root of the female recesses of the first and second guiding sections may extend from a distance FL3 to a distance FL4 from the transverse centre axis and from a distance FW3 to a distance FW4 from the longitudinal centre axis, wherein FL3<ML3<ML4<FL4 and FW3<MW3<MW4<FW4. Further, (each of) the male projections of the third and fourth guiding sections may fit into (each of) the female recesses of the first and second guiding sections. The meaning of "fit" is as defined above. This embodiment may enable alignment of the heat transfer plate and first and second adjacent heat transfer plates of the same type as the heat transfer plate, or at least comprising guiding sections as above defined, by insertion of the male projections of the third and fourth guiding sections of the heat transfer plate in the female recesses of the first and second guiding sections of the first and second adjacent heat transfer plates, and reception, of the male projections of the third and fourth guiding sections of the first and second adjacent heat transfer plates, by the female recesses of the first and second guiding sections of the heat transfer plate.

The first and fourth guiding sections may each comprise a first plane portion extending between the outer edge of the heat transfer plate and the male projection, or even surrounding the male projection, and extending parallel to the central extension plane. Further, the second and third guiding sections may each comprise a second plane portion extending between the outer edge of the heat transfer plate and the male projection, or even surrounding the male projection, and extending parallel to the central extension plane. This embodiment excludes arrangement of the male projections immediately at an outer edge portion of the heat transfer plate which may improve the stability of the guiding sections.

Similarly, the first and fourth guiding sections may each comprise a second plane portion extending between the outer edge of the heat transfer plate and the female recess, or even surrounding the female recess, and extending parallel to the central extension plane, and the second and third guiding sections may each comprise a first plane portion extending between the outer edge of the heat transfer plate and the female recess, or even surrounding the female recess, and extending parallel to the central extension plane. This embodiment excludes arrangement of the female recesses immediately at an outer edge portion of the heat transfer plate which may improve the stability of the guiding sections.

The first and second plane portions referred to above may extend in different planes. For example, they may extend in the first and the second plane, respectively, of the heat transfer plate. The first and second plane portions may then be arranged to abut the first and the second adjacent heat transfer plate, respectively, which may improve the stability of the guiding sections.

Each of the first plane portions of the first, second, third and fourth guiding sections may "branch" towards the outer edge of the heat transfer plate so as to define and at least partly enclose a respective third plane portion extending in the second plane.

The heat transfer plate may be such that, as seen from the first side of the heat transfer plate, two reinforcement recesses, in relation to the first plane portions, are arranged on opposite sides of each of the first plane portions, and two reinforcement projections, in relation to the second plane portions, are arranged on opposite sides of each of the second plane portions. The reinforcement recesses and projections may be arranged in succession along the outer edge of the heat transfer plate. As implied by the names, the reinforcement recesses and projections are arranged to reinforce and stiffen the heat transfer plate so as to reduce the risk of deformation of the guiding sections of the heat transfer plate when this engages with the first and second adjacent heat transfer plates, which could affect the alignment of the three heat transfer plates negatively. Bottoms of the reinforcement recesses may extend in the second plane while tops of the reinforcement projections may extend in the first plane. The reinforcement recesses and projections may then be arranged to abut the first and the second adjacent heat transfer plate, respectively, which may improve the stability of the guiding sections. For example, one or more of the reinforcement recesses and projections could comprise a respective one of the corrugations of the edge portion of the heat transfer plates.

The first, second, third and fourth guiding sections may be arranged at a respective one of four corners of the heat transfer plate. Then, the guiding sections may be arranged as far from each other as is possible and suitable which may result in an optimized alignment between the heat transfer plate and the first and second adjacent heat transfer plates.

The heat transfer plate may comprise two opposing long sides extending parallel to the longitudinal centre axis and two opposing short sides extending parallel to the transverse centre axis. Within each of the first, second, third and fourth guiding sections, the female recess and the male projection may be arranged on opposite sides of an imaginary straight line extending with an angle of 45 degrees in relation to one of the long sides and one of the short sides of the heat transfer plate. This may result in an optimized alignment between the heat transfer plate and the first and second adjacent heat transfer plates.

The heat transfer plate may be so designed that a depth of the female recesses of the third and fourth guiding sections is a ≥height of the male projections of the first and second guiding sections, and a depth of the female recesses of the first and second guiding sections is a ≥height of the male projections of the third and fourth guiding sections. Such an embodiment may enable that the complete male projections of the heat transfer plate may be received in recesses of first and second adjacent heat transfer plates of the same type as the heat transfer plate, or at least comprising guiding sections as above defined, and that the female recesses of the heat transfer plate completely may receive male projections of the first and second adjacent heat transfer plates. In turn, this enables an optimized alignment of the heat transfer plate and the first and second adjacent heat transfer plates.

At least one of the male projections of the first and second guiding sections and at least one of the female recesses of the third and fourth guiding sections may have an at least partly uniform cross section parallel to the central extension plane. Similarly, at least one of the female recesses of the first and second guiding sections and at least one of the male projections of the third and fourth guiding sections may have an at least partly uniform cross section parallel to the central extension plane. Thereby, a good fit between the male projections and the female recesses of the heat transfer plate and first and second adjacent heat transfer plates of the same type as the heat transfer plate, or at least comprising guiding sections as above defined, may be enabled.

At least one of the male projections of the first and second guiding sections and at least one of the female recesses of the third and fourth guiding sections may have a cross section parallel to the central extension plane comprising two perpendicular portions, i.e. two portions that are perpendicular to each other, each. Similarly, at least one of the female recesses of the first and second guiding sections and at least one of the male projections of the third and fourth guiding sections may have a cross section parallel to the central extension plane comprising two perpendicular portions each. Thereby, alignment, in two perpendicular directions, i.e. optimum alignment, of the heat transfer plate and first and second adjacent heat transfer plates of the same type as the heat transfer plate, or at least comprising guiding sections as above defined, may be enabled.

A plate pack for a heat exchanger according to the invention comprises a first, a second and a third heat transfer plate as described above, which heat transfer plates may or may not be similar. The second heat transfer plate is arranged between the first and third heat transfer plates. When the first and second sides of the second heat transfer plate abut the second side of the first heat transfer plate and the first side of the third heat transfer plate, respectively, and the second heat transfer plate is rotated 180 degrees in relation to the first and third heat transfer plates about an axis extending parallel to a normal of the central extension plane, and through a cross point between the longitudinal and transverse centre axes, of the second heat transfer plate, i.e. when the heat transfer plates are rotated in relation to each other with the above definition, the male projections of the first and fourth guiding sections of the second heat transfer plate are received in the female recesses of the fourth and first guiding sections, respectively, of the first heat transfer plate, the male projections of the second and third guiding portions of the first heat transfer plate are received in the female recesses of the third and second guiding sections, respectively, of the second heat transfer plate, the male projections of the fourth and first guiding sections of the third heat transfer plate are received in the female recesses of the first and fourth guiding sections, respectively, of the second heat transfer plate, and the male projections of the second and third guiding portions of the second heat transfer plate are received in the female recesses of the third and second guiding sections, respectively, of the third heat transfer plate.

Further, when the first and second sides of the second heat transfer plate abut the first side of the first heat transfer plate and the second side of the third heat transfer plate, respectively, and the second heat transfer plate is rotated 180 degrees in relation to the first and third heat transfer plates about an axis coinciding with the transverse centre axis of the second heat transfer plate, i.e. when the heat transfer plates are flipped in relation to each other with the above definition, the male projections of the first and fourth guiding sections of the second heat transfer plate are received in the female recesses of the third and second guiding sections, respectively, of the first heat transfer plate, the male projections of the first and fourth guiding sections of the first heat transfer plate are received in the female recesses of the third and second guiding sections, respectively, of the second heat transfer plate, the male projections of the second and third guiding sections of the third heat transfer plate are received in the female recesses of the fourth and first guiding sections, respectively, of the second heat transfer plate, and the male projections of the second and third guiding sections of the second heat transfer plate are received in the female recesses of the fourth and first guiding sections, respectively, of the third heat transfer plate.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1:
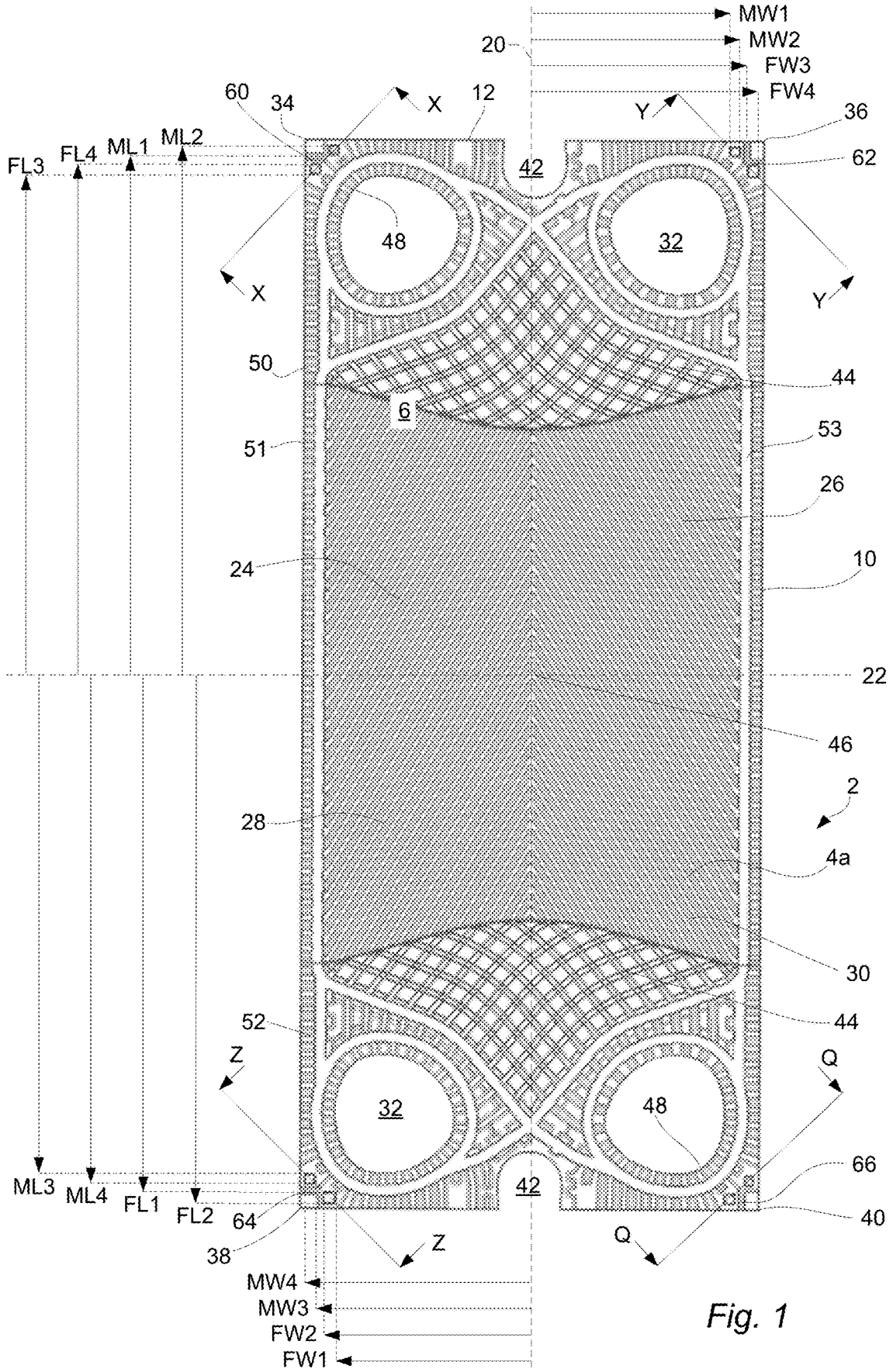
FIG. 1 is a schematic plan view of a heat transfer plate and a plate pack for a heat exchanger according to the invention.

With reference to FIG. 1, a plate pack 2 for a gasketed plate heat exchanger comprising a plurality of heat transfer plates is shown. All of the heat transfer plates are of the same type. In FIGS. 4*a*-4*d*, which will be further discussed below, a first, a second and a third heat transfer plate 4*a*, 4*b* and 4*c*, respectively, of this plurality of heat transfer plates are illustrated. The first heat transfer plate 4*a* is also visible in FIG. 1. The design and function of a gasketed plate heat exchanger are well known and were discussed by way of introduction and, therefore, no further description is given here.

The heat transfer plate 4*a* will now be further described with reference to FIGS. 1, 2*a*-2*d* and 3*a*-3*g* which illustrate the heat transfer plate and portions and cross sections of the heat transfer plate, respectively. The heat transfer plate 4*a* is an essentially rectangular sheet of stainless steel having opposing first and second sides 6 and 8, respectively, which also may be referred to as front and back sides. In FIG. 1, only the first side 6 is visible. The heat transfer plate 4*a* comprises two opposing long sides 10 and two opposing short sides 12.

The heat transfer plate further has a longitudinal centre axis 20 extending parallel to, and half way between, the long sides 10, and a transverse centre axis 22 extending parallel to, and half way between, the short sides 12, and thus perpendicular to the longitudinal centre axis 20 (FIG. 1). The longitudinal and transverse centre axes divide the heat transfer plate 4*a* into four equally large first, second, third and four plate areas, 24, 26, 28 and 30, respectively. The first and second plate areas 24 and 26 are arranged on the same side of the transverse centre axis 22 while the first and the third plate areas 24 and 28 are arranged on the same side of the longitudinal centre axis 20.

The heat transfer plate 4*a* comprises four port holes 32 arranged at a respective one of four corners 34, 36, 38 and 40 of the heat transfer plate, and recesses 42 extending from a respective one of the short sides 12 of the heat transfer plate 4*a* and arranged to receive carrying and guiding bars of the plate heat exchanger.

The heat transfer plate 4*a* is pressed, in a conventional manner, in a pressing tool, to be given a desired structure, more particularly different corrugation patterns within different portions of the heat transfer plate. The corrugation patterns are optimized for the specific functions of the respective plate portions. Accordingly, the heat transfer plate 4*a* comprises two distribution areas 44 which each is provided with a distribution pattern adapted for optimized fluid distribution across the heat transfer plate. Further, the heat transfer plate 4*a* comprises a heat transfer area 46 arranged between the distribution areas 44 and provided with a heat transfer pattern adapted for optimized heat transfer between two fluids flowing on opposite sides of the heat transfer plate. Moreover, the heat transfer plate 4*a* comprises inner edge portions 48 surrounding the port holes 32 and an outer edge portion 50 extending along an outer edge 51 of the heat transfer plate 4*a*. The inner and outer edge portions 48 and 50 comprises corrugations 52 which make the inner and outer edge portions stiffer and, thus, the heat transfer plate 4*a* more resistant to deformation. Further, the corrugations 52 form a support structure in that they are arranged to abut adjacent heat transfer plates when the heat transfer plate 4*a* is arranged in the plate heat exchanger. Depending on the design of the distribution and heat transfer patterns, the heat transfer plate 4*a* may also be arranged to abut adjacent heat transfer plates within the distribution and heat transfer areas 44 and 46, respectively, when the heat transfer plate is arranged in the plate heat exchanger. However, this is not further discussed herein. Also, the heat transfer plate 4*a* comprises a groove 53 arranged to receive a gasket.

Figure 2A:
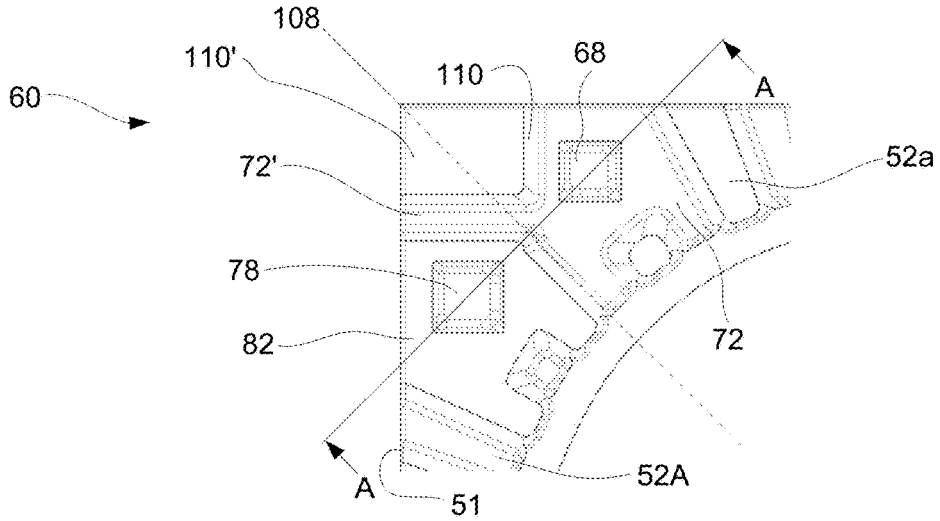
FIG. 2*a* is a schematic plan view of an upper left corner portion of the heat transfer plate of FIG. 1 comprising a first guiding section.
Figure 3A:
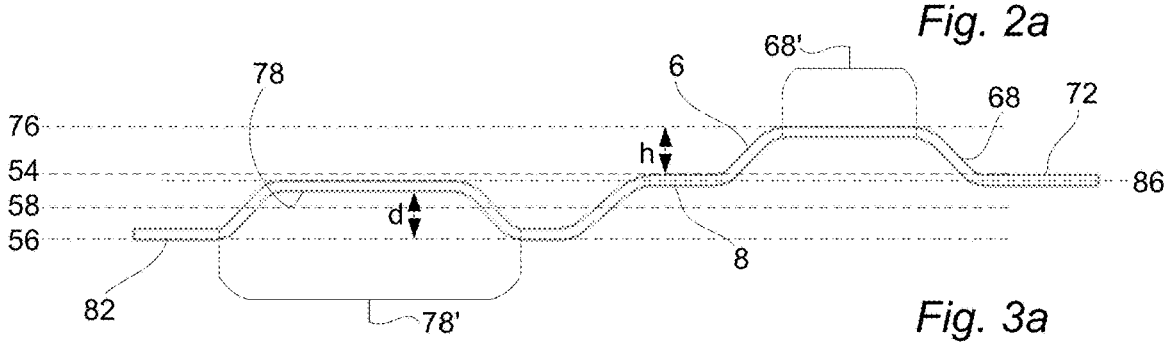
Figure 2B:
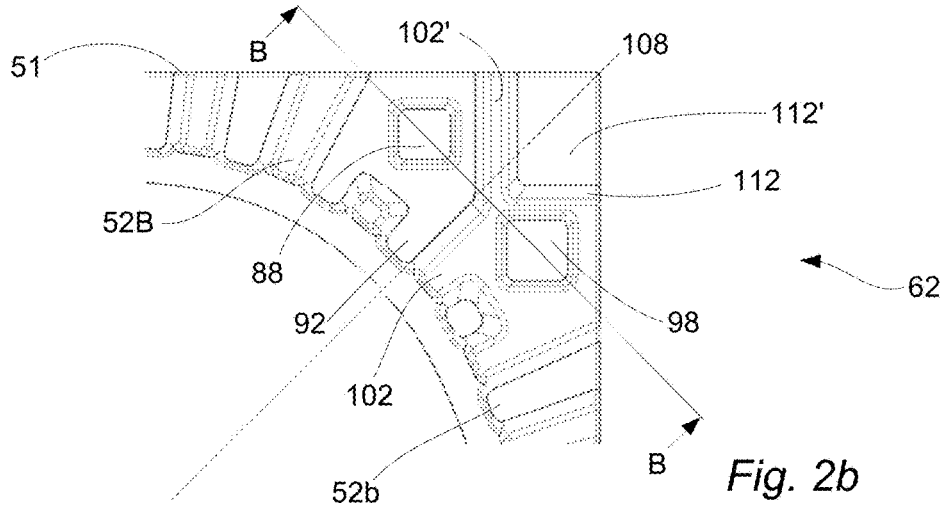
FIG. 2*b* is a schematic plan view of an upper right corner portion of the heat transfer plate of FIG. 1 comprising a second guiding section.
Figure 3B:
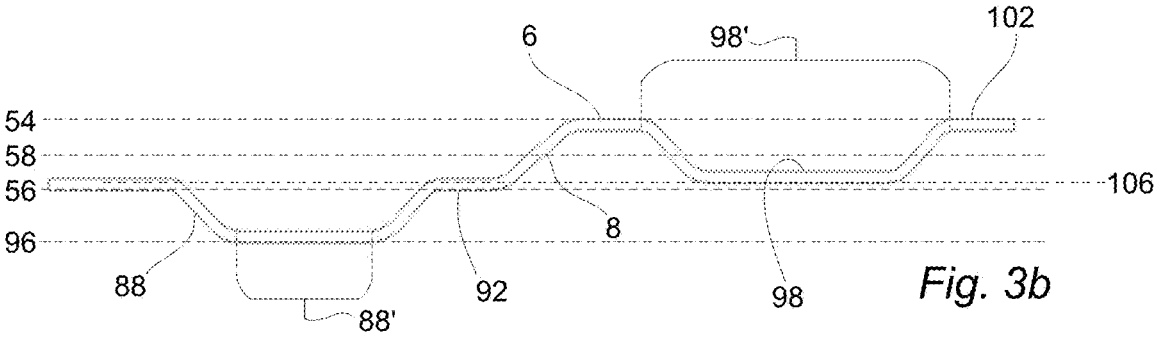
Figure 2C:
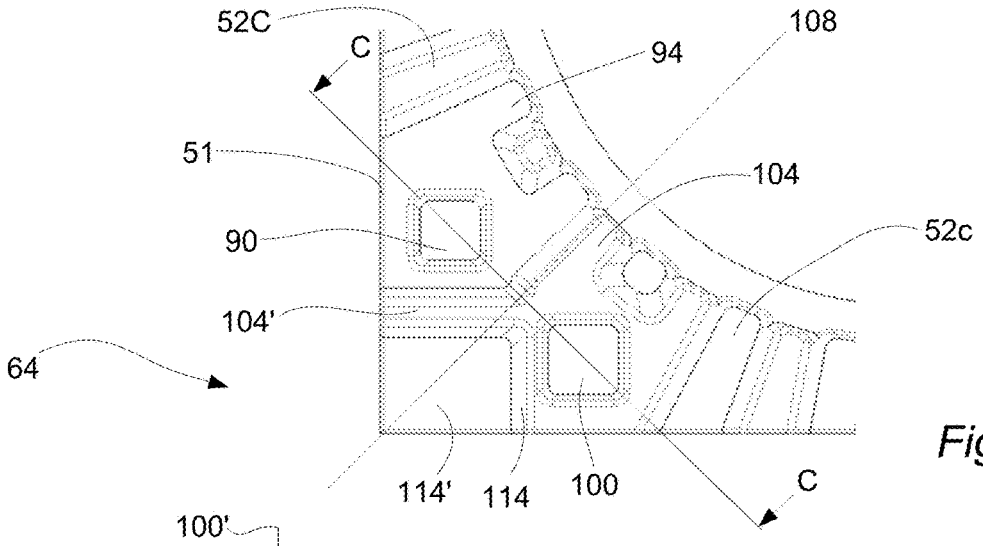
FIG. 2*c* is a schematic plan view of an lower left corner portion of the heat transfer plate of FIG. 1 comprising a third guiding section.
Figure 3C:
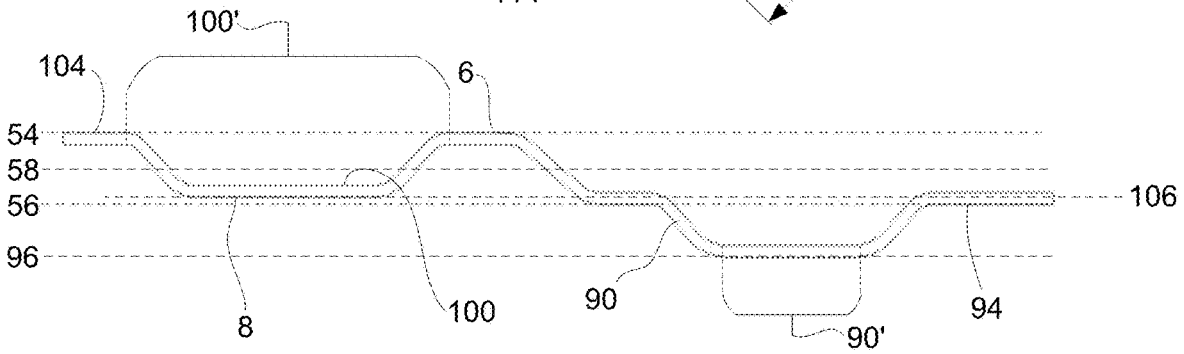
Figure 2D:
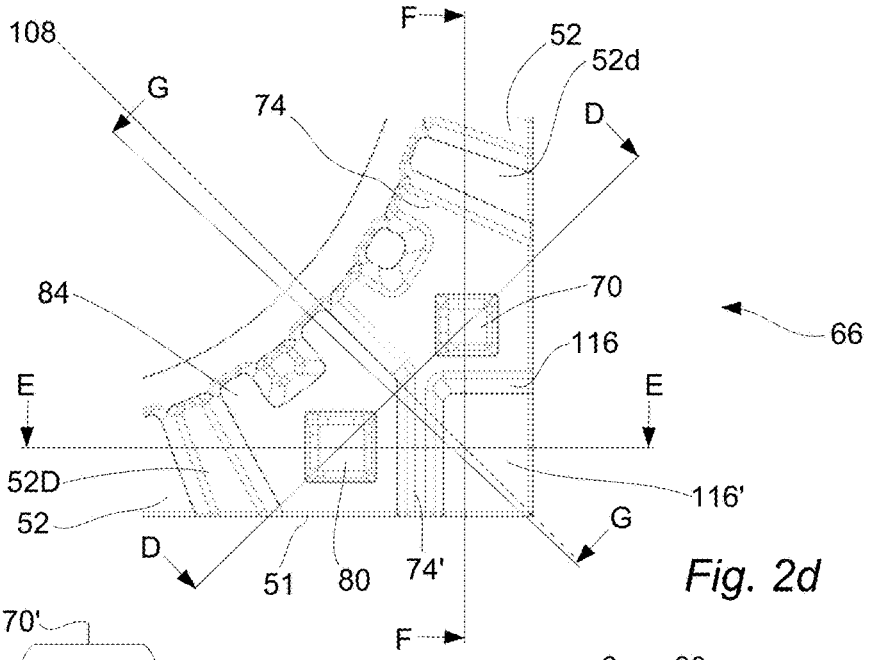
FIG. 2*d* is a schematic plan view of an lower right corner portion of the heat transfer plate of FIG. 1 comprising a fourth guiding section, FIG. 3*a* schematically illustrates a cross section A-A of the portion of FIG. 2*a*, FIG. 3*b* schematically illustrates a cross section B-B of the portion of FIG. 2*b*, FIG. 3*c* schematically illustrates a cross section C-C of the portion of FIG. 2*c*, FIG. 3*d* schematically illustrates a cross section D-D of the portion of FIG. 2*d*, FIG. 3*e* schematically illustrates a cross section E-E of the portion of FIG. 2*d*, FIG. 3*f* schematically illustrates a cross section F-F of the portion of FIG. 2*d*, FIG. 3*g* schematically illustrates a cross section G-G of the portion of FIG. 2*d*, FIG. 4*a* schematically illustrates a cross section X-X of a portion of the plate pack of FIG. 1, with heat transfer plates rotated in relation to each other, FIG. 4*b* schematically illustrates a cross section Y-Y of a portion of the plate pack of FIG. 1, with heat transfer plates rotated in relation to each other, FIG. 4*c* schematically illustrates a cross section Z-Z of a portion of the plate pack of FIG. 1, with heat transfer plates rotated in relation to each other, FIG. 4*d* schematically illustrates a cross section Q-Q of a portion of the plate pack of FIG. 1, with heat transfer plates rotated in relation to each other, FIG. 5*a* schematically illustrates a cross section of a portion of a plate pack corresponding to cross section X-X, with heat transfer plates flipped in relation to each other, FIG. 5*b* schematically illustrates a cross section of a portion of a plate pack corresponding to cross section Y-Y, with heat transfer plates flipped in relation to each other, FIG. 5*c* schematically illustrates a cross section of a portion of a plate pack corresponding to cross section Z-Z, with heat transfer plates flipped in relation to each other, FIG. 5*d* schematically illustrates a cross section of a portion of a plate pack corresponding to cross section Q-Q, with heat transfer plates flipped in relation to each other, FIG. 6 schematically illustrates a cross section of the plate pack portion of FIGS. 4*a*-4*d* as well as the plate pack portion of FIGS. 5*a*-5*d* parallel to a respective longitudinal centre axis, and through a respective outer edge portion, of the heat transfer plates, and FIG. 7 schematically illustrates an alternative cross section of a female recess or a male projection of the guiding sections.
Figure 3D:
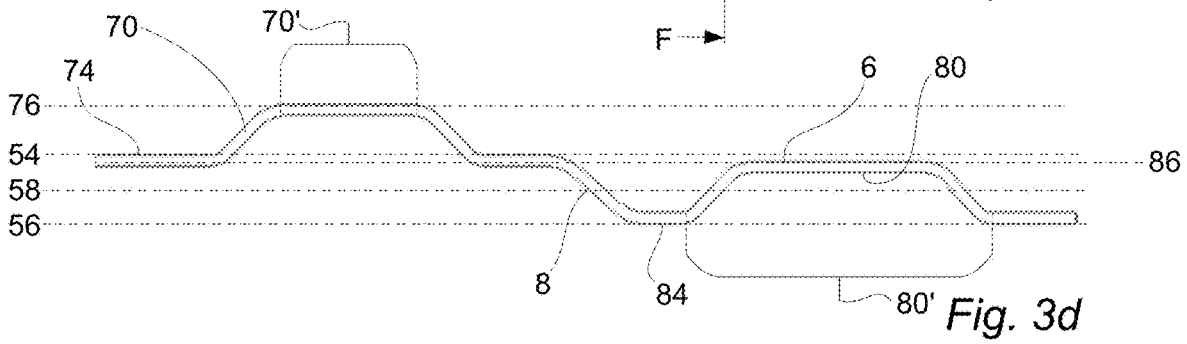
Figure 3E:
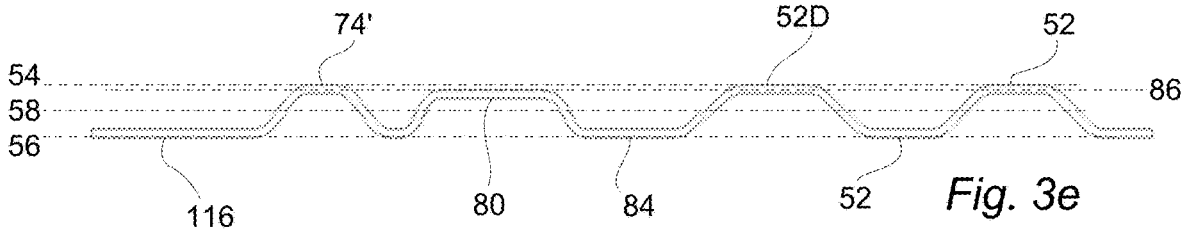
Figure 3F:
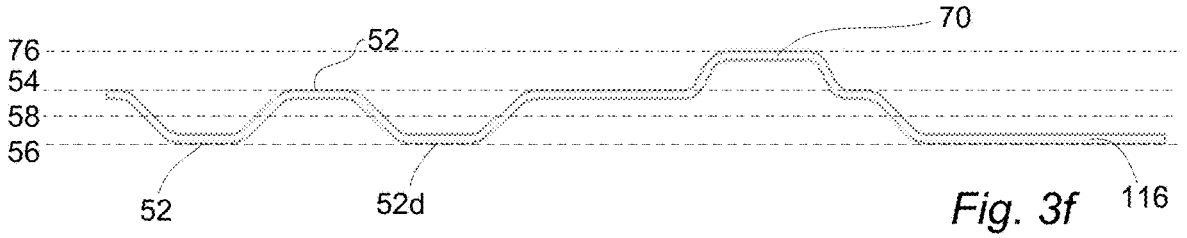
Figure 3G:
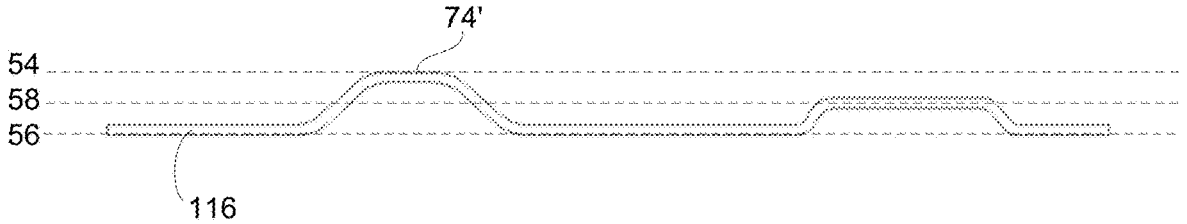

With reference especially to FIGS. 2*d*, 3*e* and 3*f*, the corrugations 52 extend within and between a first plane 54 and a second plane 56, which are parallel to a central extension plane 58 and to the figure plane of FIG. 1. The central extension plane 58 extends half way between the first and second planes 54 and 56, respectively, and a bottom of the groove 53 extends in the central extension plane, i.e. in so called half plane.

The first, second, third and fourth plate areas 24, 26, 28 and 30 comprise a first, second, third and fourth guiding section 60, 62, 64 and 66, respectively, arranged at a respective one of the four corners 34, 36, 38 and 40 of the heat transfer plate 4*a*. With reference especially to FIGS. 2*a*, 3*a*, 2*d*, 3*d* and 3*f*, the first and fourth guiding sections 60 and 66 comprise, as seen from the first side 6 of the heat transfer plate 4*a*, a respective male projection 68 and 70. The male projections 68 and 70 project from a respective first plane portion 72 and 74 of the first and fourth guiding sections 60 and 66 surrounding the respective male projections 68 and 70 and extending in the first plane 54. Thus, the male projections 68 and 70 project from the first plane 54, to a third plane 76 arranged on the opposite side of the first plane 54 than the central extension plane 58. Further, the first and fourth guiding sections 60 and 66 comprise, as seen from the second side 8 of the heat transfer plate 4*a*, a respective female recess 78 and 80. The female recesses 78 and 80 extend from a respective second plane portion 82 and 84 of the first and fourth guiding sections 60 and 66 surrounding the respective female recesses 78 and 80 and extending in the second plane 56. Thus, the female recesses 78 and 80 extend from the second plane 56, to a fourth plane 86 arranged on the same side of the central extension plane 58 as the first plane 54.

Similarly, with reference especially to FIGS. 2*b*, 3*b*, 2*c* and 3*c* the second and third guiding sections 62 and 64 comprise, as seen from the second side 8 of the heat transfer plate 4*a*, a respective male projection 88 and 90. The male projections 88 and 90 project from a respective second plane portion 92 and 94 of the second and third guiding sections 62 and 64 surrounding the respective male projections 88 and 90 and extending in the second plane 56. Thus, the male projections 88 and 90 projects from the second plane 56, to a fifth plane 96 arranged on the opposite side of the second plane 56 than the central extension plane 58. Further, the second and third guiding sections 62 and 64 comprise, as seen from the first side 6 of the heat transfer plate 4*a*, a respective female recess 98 and 100. The female recesses 98 and 100 extend from a respective first plane portion 102 and 104 of the second and third guiding sections 62 and 64 surrounding the respective female recesses 98 and 100 and extending in the first plane 54. Thus, the female recesses 102 and 104 extends from the first plane 54, to a sixth plane 106 arranged on the same side of the central extension plane 58 as the second plane 56.

Naturally, the male projections as seen from one side of the heat transfer plate forms female recesses as seen from the other side of the plate, and vice versa.

Thus, as is clear from FIGS. 2*a*, 2*b*, 2*c* and 2*d*, each of the first, second, third and fourth guiding sections 60, 62, 64 and 66 comprises a male projection and a female recess. Within each of the first, second, third and fourth guiding sections, the female recess and the male projection are arranged on opposite sides of an imaginary straight line 108 extending from the respective one of the corners 34, 36, 38 and 40 with an angle of 45 degrees in relation to the long side and the short side defining the respective one of the corners.

The male projections 68, 70, 88 and 90 and the female recesses 78, 80, 98 and 100 all have, parallel to the central extension plane 58, an essentially uniform rectangular cross section, with a cross section of the female recesses being larger than the cross section of the male projections. All the female recesses have essentially the same cross section while all the male projections have essentially the same cross section. Thus, the male projections fit into the female recesses. Further, all the female recesses have essentially the same depth d while all the male projections have essentially the same height h, and d is essentially equal to h. The depth d and height h of the female recess 78 and the male projection 68 of the first guiding section 60 is illustrated in FIG. 2*a*.

As is clear from FIG. 1 in combination with FIGS. 2*a*, 2*b*, 2*c* and 2*d*, an opening 78' and 98' of each of the female recesses 78 and 98 of the first and second guiding sections 60 and 62, respectively, extends from a distance FL3 to a distance FL4 from the transverse centre axis 22, and from a distance FW3 to a distance FW4 from the longitudinal centre axis 20. Further, a top 90' and 70' of each of the male projections 90 and 70 of the third and fourth guiding sections 64 and 66, respectively, extends from a distance ML3 to a distance ML4 from the transverse centre axis 22, and from a distance MW3 to a distance MW4 from the longitudinal centre axis 20. FL3<ML3<ML4<FL4 and FW3<MW3<MW4<FW4. Furthermore, a top 68' and 88' of each of the male projections 68 and 88 of the first and second guiding sections 60 and 62, respectively, extends from a distance ML1 to a distance ML2 from the transverse centre axis 22, and from a distance MW1 to MW2 from the longitudinal centre axis 20. Further, an opening 100' and 80' of each of the female recesses 100 and 80 of the third and fourth guiding sections 64 and 66, respectively, extends from a distance FL1 to a distance FL2 from the transverse centre axis 22, and from a distance FW1 to a distance FW2 from the longitudinal centre axis 20. FL1<ML1<ML2<FL2 and FW1<MW1<MW2<FW2.

With reference especially to FIGS. 2*a*, 2*b*, 2*c*, 2*d*, 3*e*, 3*f* and 3*g*, in order to stiffen the corners 34, 36, 38 and 40 of the heat transfer plate 4*a*, each of the first plane portions 72, 102, 104 and 74 of the first, second, third and fourth guiding sections 60, 62, 64 and 66, respectively, "branches" towards the outer edge 51 of the heat transfer plate 4*a* so as to define and partly enclose a third plane portion 110', 112', 114' and 116', respectively, extending in the second plane 56. More particularly, the first plane portions 72, 102, 104 and 74 each comprises a "branch" or sub portion forming a first reinforcement projection 72', 102', 104' and 74' on one side of the respective one of the second plane portions 82, 92, 94 and 84. The respective most adjacent one of the corrugations 52 on the other opposing side of the second plane portions 82, 92, 94 and 84 forms second reinforcement projections 52A, 52B, 52C and 52D. Each of the third plane portions 110', 112', 114' and 116' forms a bottom of a respective first reinforcement recesses 110, 112, 114 and 116 arranged on one side of the respective one of the first plane portions 72, 102, 104 and 74. The respective most adjacent one of the corrugations 52 on the other opposing side of the first plane portions 72, 102, 104 and 74 forms second reinforcement recesses 52*a*, 52*b*, 52*c* and 52*d*.

Figure 6:
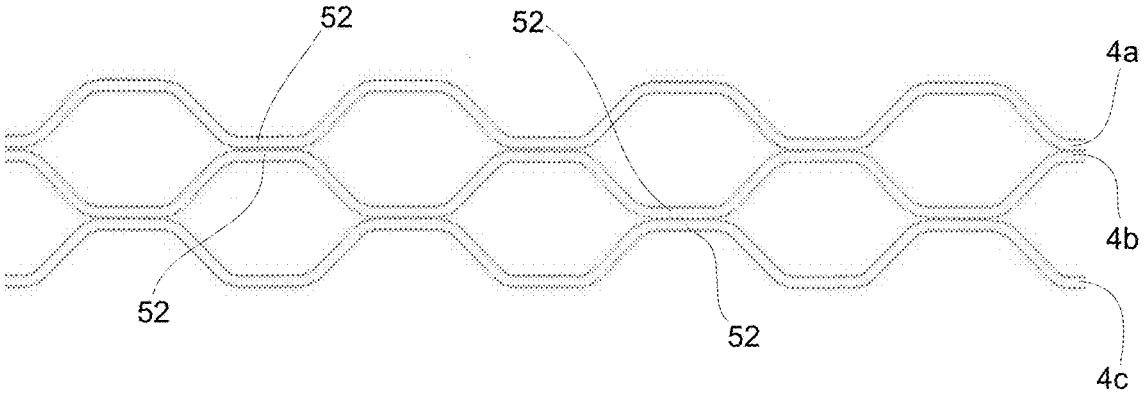

FIGS. 4*a*-4*d* illustrate cross sections of the first, second and third heat transfer plates 4*a*, 4*b* and 4*c* of the plate pack 2 of FIG. 1. The second heat transfer plate 4*b* is arranged between the first and third heat transfer plates 4*a* and 4*c*. Further, the second heat transfer plate 4*b* is rotated 180 degrees about an axis perpendicular to, and extending through a cross point between, its transverse and longitudinal centre axes 20 and 22, in relation to the first and third heat transfer plates 4*a* and 4*c*. Thereby, the first and second sides 6 and 8 of the second heat transfer plate 4*b* abut the second side 8 of the first heat transfer plate 4*a* and the first side 6 of the third heat transfer plate 4*c*, respectively. More particularly, portions of the second heat transfer plate 4*b* extending in the first plane 54 contact opposing portions of the first heat transfer plate 4*a* extending in the second plane 56, and portions of the second heat transfer plate 4*b* extending in the second plane 56 contact opposing portions of the third heat transfer plate 4*c* extending in the first plane 54. For example, as schematically illustrated in FIG. 6 for the outer edge portions of the heat transfer plates 4*a*, 4*b* and 4*c*, the corrugations 52 of the inner and outer edge portions 48 and 50 (FIG. 1) of the second heat transfer plate 4*b* abut the corrugations 52 of the inner and outer edge portions 48 and 50 of the first and third heat transfer plates 4*a* and 4*c* at the first side 6 and the second side 8, respectively, of the second heat transfer plate 4*b*. Further, the first reinforcement projections 72', 102', 104', 74' and the third plane portions 110', 112', 114', 116' of the second heat transfer plate 4*b* partly abut the third plane portions 116', 114', 112', 110' of the first heat transfer plate 4*a* and the first reinforcement projections 74', 104', 102', 72' of the third heat transfer plate 4*c*, respectively.

Figure 4A:
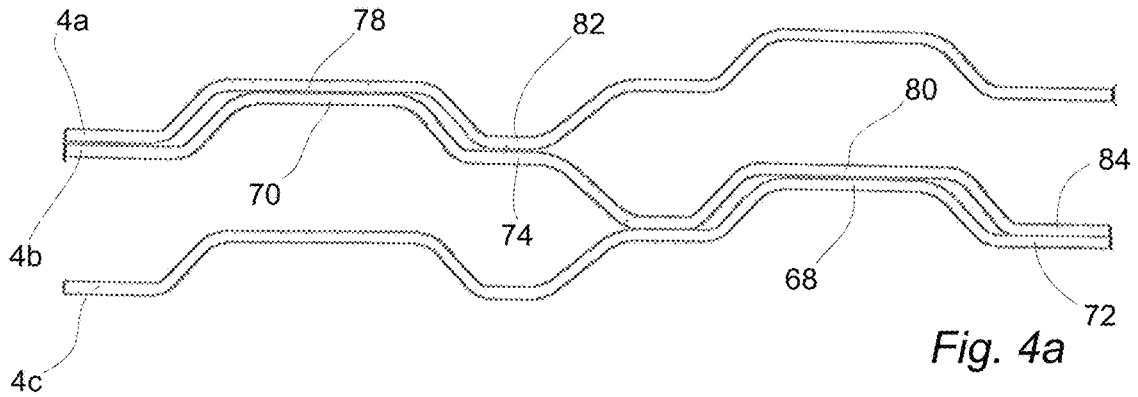

Further, the fourth guiding section 66 of the second heat transfer plate 4*b* engages with the first guiding sections 60 of the first and third heat transfer plates 4*a* and 4*c* (FIG. 4*a*). More particularly, the male projection 70 of the second heat transfer plate 4*b* is received in the female recess 78 of the first heat transfer plate 4*a* and the first plane portion 74 of the second heat transfer plate 4*b* abuts the second plane portion 82 of the first heat transfer plate 4*a*. Further, the male projection 68 of the third heat transfer plate 4*c* is received in the female recess 80 of the second heat transfer plate 4*b* and the first plane portion 72 of the third heat transfer plate 4*c* abuts the second plane portion 84 of the second heat transfer plate 4*b*.

Figure 4B:
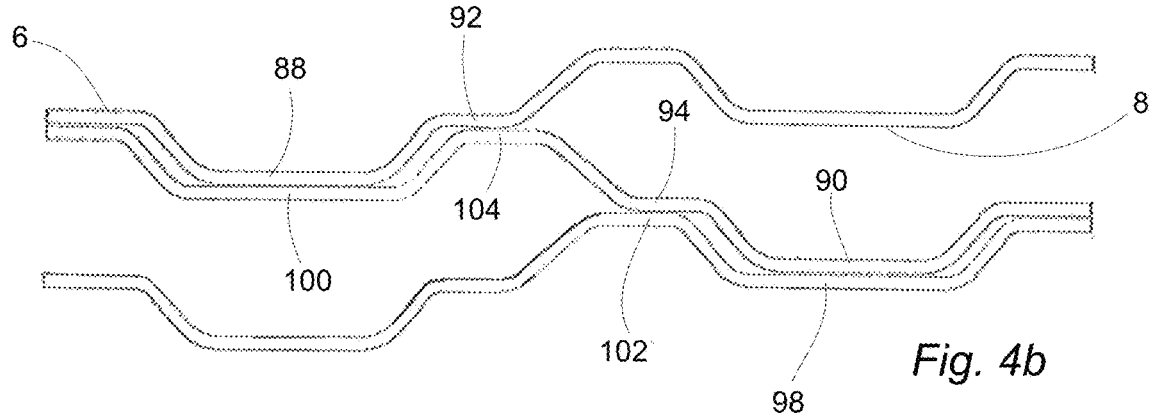

Further, the third guiding section 64 of the second heat transfer plate 4*b* engages with the second guiding sections 62 of the first and third heat transfer plates 4*a* and 4*c* (FIG. 4*b*). More particularly, the male projection 88 of the first heat transfer plate 4*a* is received in the female recess 100 of the second heat transfer plate 4*b* and the second plane portion 92 of the first heat transfer plate 4*a* abuts the first plane portion 104 of the second heat transfer plate 4*b*. Further, the male projection 90 of the second heat transfer plate 4*b* is received in the female recess 98 of the third heat transfer plate 4*c* and the second plane portion 94 of the second heat transfer plate 4*b* abuts the first plane portion 102 of the third heat transfer plate 4*c*.

Figure 4C:
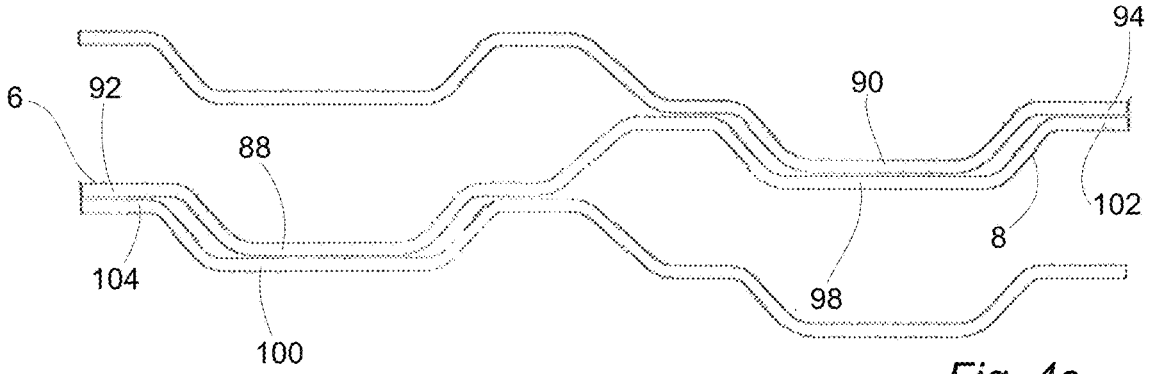

Further, the second guiding section 62 of the second heat transfer plate 4*b* engages with the third guiding sections 64 of the first and third heat transfer plates 4*a* and 4*c* (FIG. 4*c*). More particularly, the male projection 90 of the first heat transfer plate 4*a* is received in the female recess 98 of the second heat transfer plate 4*b* and the second plane portion 94 of the first heat transfer plate 4*a* abuts the first plane portion 102 of the second heat transfer plate 4*b*. Further, the male projection 88 of the second heat transfer plate 4*b* is received in the female recess 100 of the third heat transfer plate 4*c* and the second plane portion 92 of the second heat transfer plate 4*b* abuts the first plane portion 104 of the third heat transfer plate 4*c*.

Figure 4D:
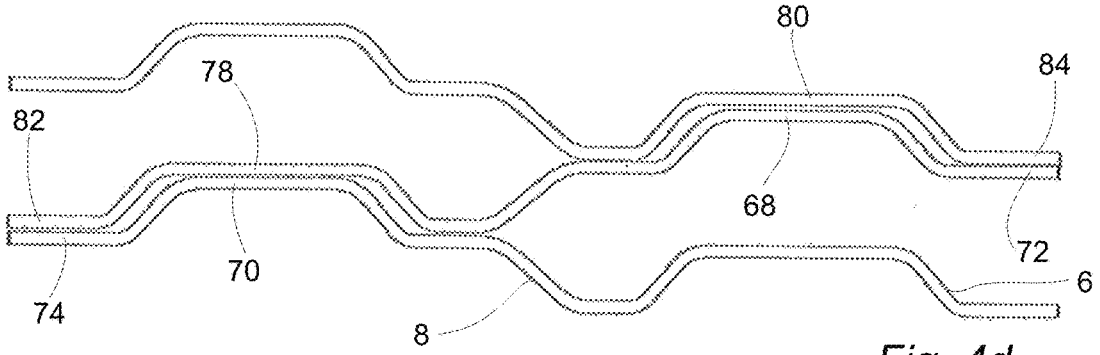

Further, the first guiding section 60 of the second heat transfer plate 4*b* engages with the fourth guiding sections 66 of the first and third heat transfer plates 4*a* and 4*c* (FIG. 4*d*). More particularly, the male projection 68 of the second heat transfer plate 4*b* is received in the female recess 80 of the first heat transfer plate 4*a* and the first plane portion 72 of the second heat transfer plate 4*b* abuts the second plane portion 84 of the first heat transfer plate 4*a*. Further, the male projection 70 of the third heat transfer plate 4*c* is received in the female recess 78 of the second heat transfer plate 4*b* and the first plane portion 74 of the third heat transfer plate 4*c* abuts the second plane portion 82 of the second heat transfer plate 4*b*.

Thereby, in the plate pack 2, the second heat transfer plate 4*b* engages, at all four of its guiding sections 60, 62, 64 and 66, with both the first and the third heat transfer plate 4*a*, 4*c*, which results in a reliable and effective alignment of the first, second and third heat transfer plates.

In the above described plate pack 2, the heat transfer plates are "rotated" in relation to each other. In an alternative plate pack according to the invention, the heat transfer plates are instead "flipped" in relation to each other. Accordingly, the second heat transfer plate 4*b* is arranged between the first and third heat transfer plates 4*a* and 4*c*. Further, the first and third heat transfer plates 4*a* and 4*b* are both rotated 180 degrees about their respective transverse centre axis 22, in relation to the second heat transfer plate 4*b*. Thereby, the first and second sides 6 and 8 of the second heat transfer plate 4*b* abut the first side 6 of the first heat transfer plate 4*a* and the second side 8 of the third heat transfer plate 4*c*, respectively. More particularly, portions of the second heat transfer plate 4*b* extending in the first plane 54 contact opposing portions of the first heat transfer plate 4*a* extending in the first plane 54, and portions of the second heat transfer plate 4*b* extending in the second plane 56 contact opposing portions of the third heat transfer plate 4*c* extending in the second plane 56. For example, as schematically illustrated in FIG. 6 for the outer edge portions of the heat transfer plates 4*a*, 4*b* and 4*c*, the corrugations 52 of the inner and outer edge portions 48 and 50 (FIG. 1) of the second heat transfer plate 4*b* abut the corrugations 52 of the inner and outer edge portions 48 and 50 of the first and third heat transfer plates 4*a* and 4*c* at the first side 6 and the second side 8, respectively, of the second heat transfer plate 4*b*. Further, the first reinforcement projections 72', 102', 104', 74' and the third plane portions 110', 112', 114', 116' of the second heat transfer plate 4*b* partly abut first reinforcement projections 104', 74', 72', 102' of the first heat transfer plate 4*a* and the third plane portions 114', 116', 110', 112' of the third heat transfer plate 4*c*, respectively.

Figure 5A:
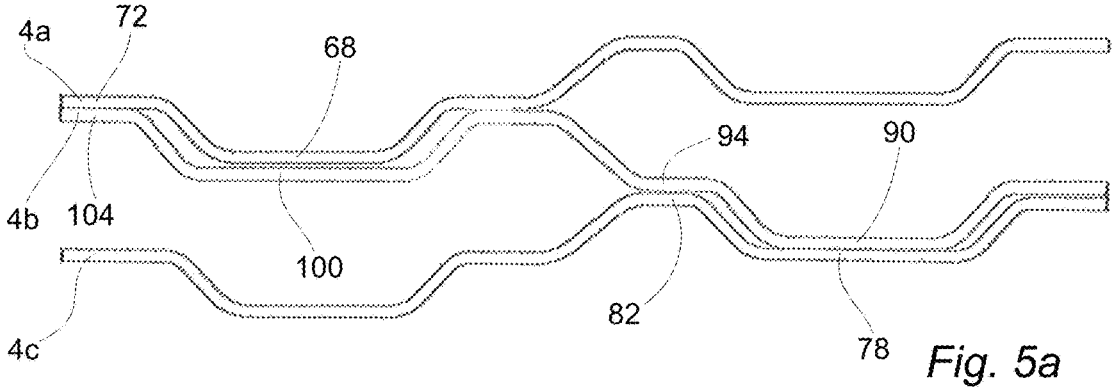

Further, the third guiding section 64 of the second heat transfer plate 4*b* engages with the first guiding sections 60 of the first and third heat transfer plates 4*a* and 4*c* (FIG. 5*a*). More particularly, the male projection 68 of the first heat transfer plate 4*a* is received in the female recess 100 of the second heat transfer plate 4*b* and the first plane portion 72 of the first heat transfer plate 4*a* abuts the first plane portion 104 of the second heat transfer plate 4*b*. Further, the male projection 90 of the second heat transfer plate 4*b* is received in the female recess 78 of the third heat transfer plate 4*c* and the second plane portion 94 of the second heat transfer plate 4*b* abuts the second plane portion 82 of the third heat transfer plate 4*c*.

Figure 5B:
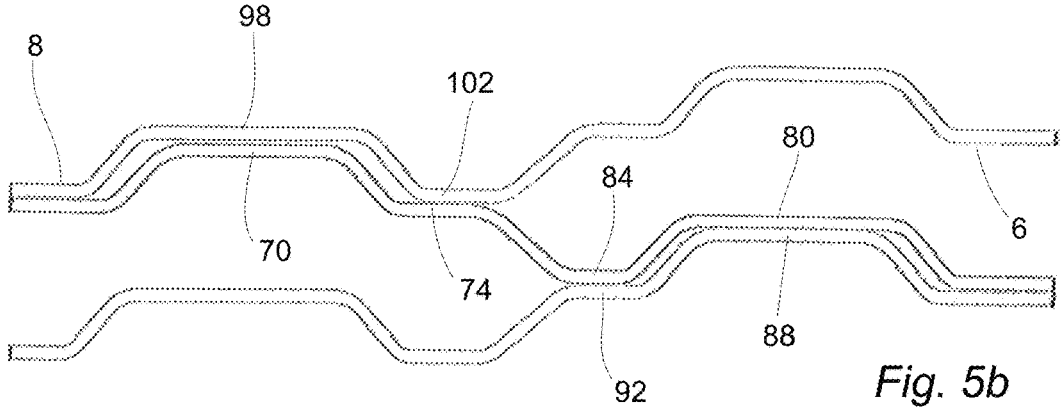

Further, the fourth guiding section 66 of the second heat transfer plate 4*b* engages with the second guiding sections 62 of the first and third heat transfer plates 4*a* and 4*c* (FIG. 5*b*). More particularly, the male projection 70 of the second heat transfer plate 4*b* is received in the female recess 98 of the first heat transfer plate 4*a* and the first plane portion 74 of the second heat transfer plate 4*b* abuts the first plane portion 102 of the first heat transfer plate 4*a*. Further, the male projection 88 of the third heat transfer plate 4*c* is received in the female recess 80 of the second heat transfer plate 4*b* and the second plane portion 92 of the third heat transfer plate 4*c* abuts the second plane portion 84 of the second heat transfer plate 4*b*.

Figure 5C:
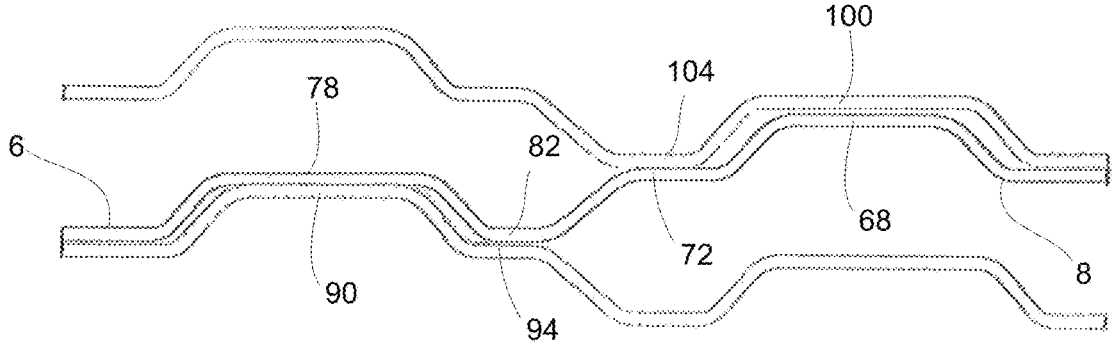

Further, the first guiding section 60 of the second heat transfer plate 4*b* engages with the third guiding sections 64 of the first and third heat transfer plates 4*a* and 4*c* (FIG. 5*c*). More particularly, the male projection 68 of the second heat transfer plate 4*b* is received in the female recess 100 of the first heat transfer plate 4*a* and the first plane portion 72 of the second heat transfer plate 4*b* abuts the first plane portion 104 of the first heat transfer plate 4*a*. Further, the male projection 90 of the third heat transfer plate 4*c* is received in the female recess 78 of the second heat transfer plate 4*b* and the second plane portion 94 of the third heat transfer plate 4*c* abuts the second plane portion 82 of the second heat transfer plate 4*b*.

Figure 5D:
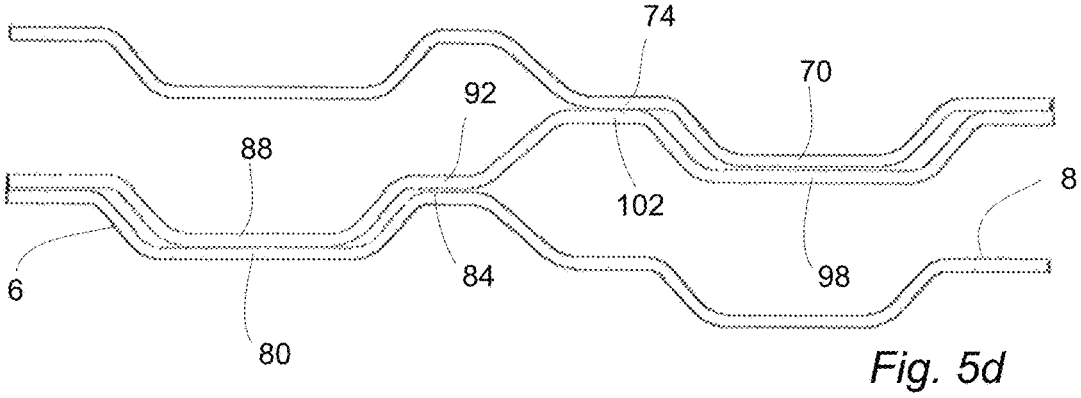

Further, the second guiding section 62 of the second heat transfer plate 4*b* engages with the fourth guiding sections 66 of the first and third heat transfer plates 4*a* and 4*c* (FIG. 5*d*). More particularly, the male projection 70 of the first heat transfer plate 4*a* is received in the female recess 98 of the second heat transfer plate 4*b* and the first plane portion 74 of the first heat transfer plate 4*a* abuts the first plane portion 102 of the second heat transfer plate 4*b*. Further, the male projection 88 of the second heat transfer plate 4*b* is received in the female recess 80 of the third heat transfer plate 4*c* and the second plane portion 92 of the second heat transfer plate 4*b* abuts the second plane portion 84 of the third heat transfer plate 4*c*.

Thereby, in the plate pack above, the second heat transfer plate 4*b* engages, at all four of its guiding sections 60, 62, 64 and 66, with both the first and the third heat transfer plate 4*a*, 4*c*, which results in a reliable and effective alignment of the first, second and third heat transfer plates.

Thus, due to the inventive construction of the first, second, third and fourth guiding sections 60, 62, 64 and 66, the heat transfer plates 4*a*, 4*b* and 4*c* are properly aligned with each other in a plate pack irrespective of whether they are rotated or flipped in relation to each other. Due to the design, and location on the heat transfer plates, of the female recesses and male projections, the actual alignment of the heat transfer plates is performed by means of outer portions of the female recesses and the male projections, i.e. portions of the female recesses and the male projections facing the respective outer edges 51 of the heat transfer plates. Thus, when the heat transfer plates are aligned, the outer portions of the female recesses and the male projections of one heat transfer plate engage with the outer portions of the male projections and the female recesses, respectively, of the adjacent plates. Inner portions of the female recesses and the male projections, i.e. portions of the female recesses and the male projections facing away from the respective outer edges 51 of the heat transfer plates, do not engage with each other.

In that the first and second plane portions 72, 74, 102, 104 and 82, 84, 92 and 94 extend in the first and second planes 54 and 56, and the depth of the female recesses 78, 80, 98 and 100 is equal to the height of the male projections 68, 70, 88 and 90, the first and second plate portions, just like inside bottom surfaces of the female recesses and outside top surfaces of the male projections, will abut each other in the plate pack and so make the plate pack more stable.

The above described embodiments of the present invention should only be seen as an example. A person skilled in the art realizes that the embodiments discussed can be varied and combined in a number of ways without deviating from the inventive conception.

Figure 7:
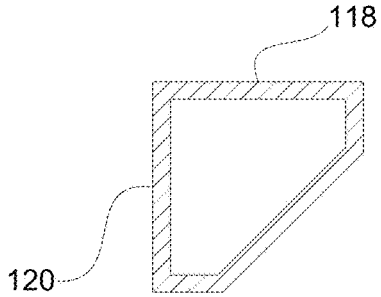

For example, the female recesses and the male projections need not have a rectangular cross section. As an example, they may have a round, triangular or pentagonal cross section, such as the cross section illustrated in FIG. 7, which defines a right angle and comprises two outer portions 118 and 120 which are perpendicular to each other for optimum heat transfer plate alignment. Since the alignment function resides within the outer portions 118 and 120, the inner portions can be cut or shortened so as to enable space efficient female recesses and male projections with large alignment capability.

Further, the female recesses need not all have the same cross section and the same depth. Similarly, the male projections need not all have the same cross section and the same height. Also, the depth of the female recesses need not be equal to the height of the male projections but could be larger or even smaller. Also, one or more of the first plane portions of the guiding sections may extend in a plane different from the first plane. Similarly, one or more of the second plane portions of the guiding sections may extend in a plane different from the second plane.

Also, the alignment function need not reside solely within the outer portions of the female recesses and the male projections but could instead reside solely within the inner portions of the female recesses and the male projections, or within one or more of the outer portions and/or one or more of the inner portions of the female recesses and the male projections.

The heat transfer plate need not be rectangular but may have other shapes, such as essentially rectangular with rounded corners instead of right corners, circular or oval. The heat transfer plate need not be made of stainless steel but could be of other materials, such as titanium or aluminium.

The guiding sections of the heat transfer plate need not be arranged at a respective corner of the heat transfer plate but could be arranged closer to the longitudinal centre axis and/or closer to the transverse centre axis. Also, within each of the guiding sections, the female recess and the male projection need not be arranged on opposite sides, but could instead be arranged on the same side, of the imaginary straight line 108 illustrated in FIGS. 2*a*, 2*b*, 2*c* and 2*d*. Further, the distance between the female recess and the male projection of each of the guiding section could vary. Typically, the female recesses and the male projections are arranged where there is room available on the heat transfer plate, e.g. in the corners and/or at the centre of the short sides, close to the outer edge, of the heat transfer plate.

The plate packs described above comprises one plate type only. Naturally, the plate packs could instead comprise two or more different types of alternately arranged heat transfer plates, for example heat transfer plates with different heat transfer patterns and/or guiding sections as long as the heat transfer patterns and/or the guiding sections are compatible with each other.

The present invention could be used in connection with other types of plate heat exchangers than gasketed ones, such as brazed, all-welded and semi-welded (heat transfer plates pairwise welded to each other in cassettes, which cassettes are separated by gaskets) plate heat exchangers. The present invention could also be used with plate heat exchangers lacking carrying and guiding bars, i.e. for heat transfer plates lacking recesses for receiving such carrying and guiding bars.

The locations of the first, second, central extension, third, fourth, fifth and sixth planes 54, 56, 58, 76, 86, 96 and 106 need not be as above defined but could vary. As an example, with reference to FIGS. 3*a*, 3*d* and 4*a*, the fourth plane 86 could instead extend between the second plane 56 and the central extension plane 58, and the third plane 76 could consequently extend closer to the first plane 54. As another example, the fourth plane 86 could instead extend between the first plane 54 and the third plane 76, and the third plane 76 could consequently extend farther away from the first plane 54.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate having opposing first and second sides, an outer edge and a central extension plane, the heat transfer plate having a heat transfer area provided with a heat transfer pattern configured to effect heat transfer between two fluids flowing on opposite sides of the heat transfer plate, the heat transfer pattern having an outermost periphery at which the heat transfer pattern terminates, the heat transfer plate also including an edge portion extending around the outer edge of the heat transfer plate, the edge portion comprising corrugations extending between first and second planes which are parallel to the central extension plane, the corrugations of the edge portion terminating at an innermost periphery of the edge portion, the innermost periphery of the edge portion being spaced from the outermost periphery of the heat transfer pattern, the central extension plane being arranged between the first and second planes, the corrugations being arranged, at the first side of the heat transfer plate, to abut a first adjacent heat transfer plate, and at the second side of the heat transfer plate, to abut a second adjacent heat transfer plate, when the heat transfer plate is arranged in a plate heat exchanger, wherein longitudinal and transverse centre axes of the heat transfer plate, which extend parallel to the central extension plane and perpendicular to each other, define a first, a second, a third and a fourth plate area, wherein the first and second plate areas are arranged on the same side of the transverse centre axis and the first and the third plate areas are arranged on the same side of the longitudinal centre axis, wherein the first, third and fourth plate areas comprise a first, third and fourth guiding section, respectively, the first and fourth guiding sections each comprise, as seen from the first side of the heat transfer plate, a male projection projecting beyond the first plane and arranged to engage with the first adjacent heat transfer plate for alignment of the heat transfer plate and the first adjacent heat transfer plate, and, as seen from the second side of the heat transfer plate, a female recess arranged to engage with the second adjacent heat transfer plate for alignment of the heat transfer plate and the second adjacent heat transfer plate, and the third guiding section comprises, as seen from the second side of the heat transfer plate, a male projection projecting beyond the second plane and arranged to engage with the second adjacent heat transfer plate for alignment of the heat transfer plate and the second adjacent heat transfer plate, and, as seen from the first side of the heat transfer plate, a female recess arranged to engage with the first adjacent heat transfer plate for alignment of the heat transfer plate and the first adjacent heat transfer plate.

2. A heat transfer plate according to claim 1, wherein the second plate area comprises a second guiding section comprising, as seen from the second side of the heat transfer plate, a male projection projecting beyond the second plane and arranged to engage with the second adjacent heat transfer plate for alignment of the heat transfer plate and the second adjacent heat transfer plate, and, as seen from the first side of the heat transfer plate, a female recess arranged to engage with the first adjacent heat transfer plate for alignment of the heat transfer plate and the first adjacent heat transfer plate.

3. A heat transfer plate according to claim 2, wherein a top of the male projections of the first and second guiding sections extend from a distance ML1 to a distance ML2 from the transverse centre axis and from a distance MW1 to a distance MW2 from the longitudinal centre axis, and an opening of the female recesses of the third and fourth guiding sections extend from a distance FL1 to a distance FL2 from the transverse centre axis and from a distance FW1 to a distance FW2 from the longitudinal centre axis, wherein FL1<ML1<ML2<FL2 and FW1<MW1<MW2<FW2, and the male projections of the first and second guiding sections fit into the female recesses of the third and fourth guiding sections.

4. A heat transfer plate according to claim 2, wherein a top of the male projections of the third and fourth guiding sections) extend from a distance ML3 to a distance ML4 from the transverse centre axis and from a distance MW3 to a distance MW4 from the longitudinal centre axis, and an opening of the female recesses of the first and second guiding sections extend from a distance FL3 to a distance FL4 from the transverse centre axis and from a distance FW3 to a distance FW4 from the longitudinal centre axis, wherein FL3<ML3<ML4<FL4 and FW3<MW3<MW4<FW4, and the male projections of the third and fourth guiding sections fit into the female recesses of the first and second guiding sections.

5. A heat transfer plate according to claim 2, wherein the first and fourth guiding sections each comprise a first plane portion extending between the outer edge of the heat transfer plate and the male projection and parallel to the central extension plane, and the second and third guiding sections each comprise a second plane portion extending between the outer edge of the heat transfer plate and the male projection and parallel to the central extension plane.

6. A heat transfer plate according to claim 2, wherein the first and fourth guiding sections each comprise a second plane portion extending between the outer edge of the heat transfer plate and the female recess and parallel to the central extension plane, and the second and third guiding sections each comprise a first plane portion extending between the outer edge of the heat transfer plate and the female recess and parallel to the central extension plane.

7. A heat transfer plate according to claim 5, wherein the first and second plane portions extend in the first and the second plane, respectively, of the heat transfer plate.

8. A heat transfer plate according to claim 5, wherein, as seen from the first side of the heat transfer plate, two reinforcement recesses, in relation to the first plane portions, are arranged on opposite sides of each of the first plane portions and two reinforcement projections, in relation to the second plane portions, are arranged on opposite sides of each of the second plane portions.

9. A heat transfer plate according to claim 2, wherein the first, second, third and fourth guiding sections are arranged at a respective one of four corners of the heat transfer plate.

10. A heat transfer plate according to claim 2, comprising two opposing long sides extending parallel to the longitudinal centre axis and two opposing short sides extending parallel to the transverse centre axis, wherein, within each of the first, second, third and fourth guiding sections, the female recess and the male projection are arranged on opposite sides of an imaginary straight line extending with an angle of 45 degrees in relation to one of the long sides and one of the short sides of the heat transfer plate.

11. A heat transfer plate according to claim 2, wherein a depth of the female recesses of the third and fourth guiding sections is ≥a height of the male projections of the first and second guiding sections, and a depth of the female recesses of the first and second guiding sections is ≥a height of the male projections of the third and fourth guiding sections.

12. A heat transfer plate according to claim 2, wherein at least one of the male projections of the first and second guiding sections and at least one of the female recesses of the third and fourth guiding sections have an at least partly uniform cross section parallel to the central extension plane, and at least one of the female recesses of the first and second guiding sections and at least one of the male projections of the third and fourth guiding sections have an at least partly uniform cross section parallel to the central extension plane.

13. A heat transfer plate according to claim 2, wherein at least one of the male projections of the first and second guiding sections and at least one of the female recesses of the third and fourth guiding sections have a cross section parallel to the central extension plane comprising two perpendicular portions each.

14. A heat transfer plate according to claim 2, wherein at least one of the female recesses of the first and second guiding sections and at least one of the male projections of the third and fourth guiding sections have a cross section parallel to the central extension plane comprising two perpendicular portions each.

15. A heat transfer plate according to claim 1, further comprising a groove configured to receive a gasket, the groove being located between the outermost periphery of the heat transfer pattern and the innermost periphery of the edge portion of the heat transfer plate.

16. A heat transfer plate according to claim 1, further comprising first and second opposing long sides extending parallel to the longitudinal centre axis and first and second opposing short sides extending parallel to the transverse centre axis, the first long side and the first short side defining a corner of the first guiding section, an entirety of the male projection in the first guiding section being located entirely on one side or an opposite side of an imaginary straight line extending from the corner of the first guiding section at an angle of 45 degrees in relation to the first long side and the first short side.

17. A heat transfer plate according to claim 15, further comprising first and second opposing long sides extending parallel to the longitudinal centre axis and first and second opposing short sides extending parallel to the transverse centre axis, the first long side and the second short side defining a corner of the third guiding section, an entirety of the male projection in the third guiding section being located entirely on one side or an opposite side of an imaginary straight line extending from the corner of the third guiding section at an angle of 45 degrees in relation to the first long side and the second short side.

18. A plate pack for a heat exchanger comprising a first heat transfer plate, a second heat transfer plate and a third heat transfer plate, the second heat transfer plate being arranged between the first heat transfer plate and the third heat transfer plate, the first, second and third heat transfer plates each having opposing first and second sides, an outer edge and a central extension plane and including an edge portion comprising corrugations extending between first and second planes which are parallel to the central extension plane, the central extension plane being arranged between the first and second planes, the corrugations being arranged at the first side of the second heat transfer plate to abut the first heat transfer plate, and the corrugations being arranged at the second side of the second heat transfer plate, to abut the third heat transfer plate, wherein for each of the first, second and third heat transfer plates, longitudinal and transverse centre axes which extend parallel to the respective central extension plane and perpendicular to each other, define a first, a second, a third and a fourth plate area, wherein the first and second plate areas are arranged on the same side of the transverse centre axis and the first and the third plate areas are arranged on the same side of the longitudinal centre axis, wherein the first, third and fourth plate areas comprise a first, third and fourth guiding section, respectively, the first and fourth guiding sections each comprise, as seen from the first side of the second heat transfer plate, a male projection projecting beyond the first plane and arranged to engage with the first heat transfer plate for alignment of the second heat transfer plate and the first heat transfer plate, and, as seen from the second side of the second heat transfer plate, a female recess arranged to engage with the third heat transfer plate for alignment of the second heat transfer plate and the third heat transfer plate, and the third guiding section comprises, as seen from the second side of the second heat transfer plate, a male projection projecting beyond the second plane and arranged to engage with the third heat transfer plate for alignment of the second heat transfer plate and the third heat transfer plate, and, as seen from the first side of the second heat transfer plate, a female recess arranged to engage with the first heat transfer plate for alignment of the second heat transfer plate and the first heat transfer plate, the second plate area comprising a second guiding section comprising, as seen from the second side of the second heat transfer plate, a male projection projecting beyond the second plane and arranged to engage with the third heat transfer plate for alignment of the second heat transfer plate and the third heat transfer plate, and, as seen from the first side of the second heat transfer plate, a female recess arranged to engage with the first heat transfer plate for alignment of the second heat transfer plate and the first heat transfer plate, wherein, when the first and second sides of the second heat transfer plate abut the second side of the first heat transfer plate and the first side of the third heat transfer plate, respectively, and the second heat transfer plate is rotated 180 degrees in relation to the first and third heat transfer plates about an axis extending parallel to a normal of the central extension plane, and through a cross point between the longitudinal and transverse centre axes, of the second heat transfer plate, the male projections of the first and fourth guiding sections of the second heat transfer plate are received in the female recesses of the fourth and first guiding sections, respectively, of the first heat transfer plate, the male projections of the second and third guiding portions of the first heat transfer plate are received in the female recesses of the third and second guiding sections, respectively, of the second heat transfer plate, the male projections of the fourth and first guiding sections of the third heat transfer plate are received in the female recesses of the first and fourth guiding sections, respectively, of the second heat transfer plate, and the male projections of the second and third guiding portions of the second heat transfer plate are received in the female recesses of the third and second guiding sections, respectively, of the third heat transfer plate, and wherein, when the first and second sides of the second heat transfer plate abut the first side of the first heat transfer plate and the second side of the third heat transfer plate, respectively, and the second heat transfer plate is rotated 180 degrees in relation to the first and third heat transfer plates about an axis coinciding with the transverse centre axis of the second heat transfer plate, the male projections of the first and fourth guiding sections of the second heat transfer plate are received in the female recesses of the third and second guiding sections, respectively, of the first heat transfer plate, the male projections of the first and fourth guiding sections of the first heat transfer plate are received in the female recesses of the third and second guiding sections, respectively, of the second heat transfer plate, the male projections of the second and third guiding sections of the third heat transfer plate are received in the female recesses of the fourth and first guiding sections, respectively, of the second heat transfer plate, and the male projections of the second and third guiding sections of the second heat transfer plate are received in the female recesses of the fourth and first guiding sections, respectively, of the third heat transfer plate.

19. A heat transfer plate having opposing first and second sides, an outer edge and a central extension plane, the heat transfer plate having a heat transfer area provided with a heat transfer pattern configured to effect heat transfer between two fluids flowing on opposite sides of the heat transfer plate, the heat transfer plate also including an edge portion extending around the outer edge of the heat transfer plate and located outwardly of an outer periphery of the heat transfer area, the edge portion comprising corrugations extending between first and second planes which are parallel to the central extension plane, the central extension plane being arranged between the first and second planes, the corrugations being arranged, at the first side of the heat transfer plate, to abut a first adjacent heat transfer plate, and at the second side of the heat transfer plate, to abut a second adjacent heat transfer plate, when the heat transfer plate is arranged in a plate heat exchanger, wherein longitudinal and transverse centre axes of the heat transfer plate, which extend parallel to the central extension plane and perpendicular to each other, define a first, a second, a third and a fourth plate area, wherein the first and second plate areas are arranged on the same side of the transverse centre axis and the first and the third plate areas are arranged on the same side of the longitudinal centre axis, wherein the first, third and fourth plate areas comprise a first, third and fourth guiding section, respectively, the first and fourth guiding sections each comprise, as seen from the first side of the heat transfer plate, a male projection projecting beyond the first plane and arranged to engage with the first adjacent heat transfer plate for alignment of the heat transfer plate and the first adjacent heat transfer plate, and, as seen from the second side of the heat transfer plate, a female recess arranged to engage with the second adjacent heat transfer plate for alignment of the heat transfer plate and the second adjacent heat transfer plate, and the third guiding section comprises, as seen from the second side of the heat transfer plate, a male projection projecting beyond the second plane and arranged to engage with the second adjacent heat transfer plate for alignment of the heat transfer plate and the second adjacent heat transfer plate, and, as seen from the first side of the heat transfer plate, a female recess arranged to engage with the first adjacent heat transfer plate for alignment of the heat transfer plate and the first adjacent heat transfer plate, the heat transfer plate including first and second opposing long sides extending parallel to the longitudinal centre axis and first and second opposing short sides extending parallel to the transverse centre axis, an entirety of the male projection in the first guiding section being located entirely on one side or an opposite side of an imaginary straight line extending with an angle of 45 degrees in relation to one of the long sides and one of the short sides of the heat transfer plate.

20. A heat transfer plate according to claim 19, wherein the imaginary straight line passes through a corner of the heat transfer plate at which the one of the long sides and the one of the short sides meet.

* * * * *